US007537621B1

(12) United States Patent
May

(10) Patent No.: US 7,537,621 B1
(45) Date of Patent: May 26, 2009

(54) METHOD FOR DYEING A NONWOVEN FABRIC AND APPAREL FORMED THEREFROM

(75) Inventor: Ruth E. May, Schuylkill, PA (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 546 days.

(21) Appl. No.: 11/190,635

(22) Filed: Jul. 27, 2005

(51) Int. Cl.
*D06P 3/84* (2006.01)
*D06P 3/87* (2006.01)
*D06P 1/40* (2006.01)

(52) U.S. Cl. ..... 8/529; 8/531; 8/638; 8/922; 8/924

(58) Field of Classification Search ..... 8/115.51, 8/115.7, 529, 531, 638, 922, 924
See application file for complete search history.

(56) References Cited

U.S. PATENT DOCUMENTS 3,632,301 A 1/1972 Meier-Windhorst
3,635,653 A 1/1972 Snider et al.
3,762,860 A 10/1973 Abrahams et al.
4,168,142 A * 9/1979 Hervot et al. ..... 8/101
5,509,940 A 4/1996 Zbar et al.
5,759,212 A 6/1998 Hall
6,802,873 B1 10/2004 Bartl et al.

OTHER PUBLICATIONS

Das, T. K.; Mandavawalla, A. K.; Datta, S. K. "Citric acid in textile printing" Colourage (1984), vol. 31, iss. 23, pp. 29-34.*

* cited by examiner

*Primary Examiner*—Lorna M Douyon
*Assistant Examiner*—Amina Khan
(74) *Attorney, Agent, or Firm*—Womble Carlyle Sandridge & Rice, PLLC

(57) ABSTRACT

A method is provided for dyeing a nonwoven fabric comprising a blend of fibers to a single color shade. The method includes selecting a nonwoven fabric formed of a blend of polyester and nylon fibers, where the polyester fibers comprise about X percent by weight of the fabric and the nylon fibers comprise about Y percent by weight of the fabric. A single bath is formulated having about X percent by weight disperse dye and about Y percent by weight acid dye, adjusted for the desired color shade/depth. The nonwoven fabric is then dyed to obtain a dyed fabric having a single color shade of at least Grade 4 when measured in accordance with AATCC Test Method 153 and a colorfastness of at least Grade 4 when measured in accordance with AATCC Test Method 61.

10 Claims, No Drawings

METHOD FOR DYEING A NONWOVEN FABRIC AND APPAREL FORMED THEREFROM

FIELD OF THE INVENTION

The present invention relates to the field of textile treatment and finishing, and, more particularly to a method for dyeing a nonwoven fabric comprising different fiber types to obtain enhanced color uniformity and colorfastness.

BACKGROUND OF THE INVENTION

Until recently, fabrics used to form apparel have been either knitted or woven, the various fabrics comprising yarns formed of natural or synthetic fibers or filaments, or combinations thereof. As the materials and textile arts have progressed, improved fiber, yarn, and fabric constructions have been developed in response to the demand for certain performance characteristics in the ultimate article of apparel. These characteristics include hand, stretch, hydrophobicity or hydrophilicity, pill-resistance, stain resistance, colorfastness/washfastness, etc. Accordingly, various dyeing and finishing formulations and processes have been developed for use with knitted and woven fabrics. In particular, various dye formulations and dyeing processes have been developed with a goal of dye/color uniformity, and dye colorfastness after multiple home launderings, when measured according to established industry standards.

Nonwoven fabrics, on the other hand, have conventionally been used to form expendable articles such as linings, disposable sheets and wipes, diapers, disposable napkins, etc., but not apparel. While certain dyeing processes have been developed for nonwoven fabrics, dye uniformity and colorfastness heretofore have not been important performance characteristics of nonwoven fabric, and thus dyeing and colorfastness standards do not exist for nonwoven fabrics. Although it would seem that existing dyes and dye processing could be readily used on nonwoven fabrics, nonwovens present a unique set of challenges.

First, nonwoven fabric constructions typically comprise multiple webs or mats that are interconnected together to form a fabric. Hydroentanglement or air entanglement are two mechanical processes for entangling the fibers in one web with the fibers in another web. Also, the multiple webs may be stitched together. In any event, however, since nonwoven fabrics are generally formed from yarns of smaller (denier) fibers, and since multiple webs or mats are involved, these fabrics have substantially greater surface areas that must be dyed. Further, when more than one type of fiber/yarn is used to form the nonwoven fabric, dyeing is complicated when the different fibers/yarns have different affinities for different dyestuffs. Thus, multiple dyeing steps comprising a different dye bath for each fiber or yarn type has been required.

DETAILED DESCRIPTION OF THE PREFERRED EMBODIMENTS

The present invention is directed to a method for dyeing a nonwoven fabric construction comprising different fiber types, and for producing items of apparel therefrom, having a relatively high level of dye uniformity and colorfastness.

"Nonwoven" as used herein, refers to an assembly of textile fibers held together by mechanical interlocking in a random web or mat, by fusing of the fibers, or by the use of a cementing medium.

"Dyeing" as used herein, refers to the process of coloring fibers, yarns, fabrics, or apparel with either natural or synthetic dyes.

"Colorfastness" as used herein generally refers to the resistance of a material to change in any of its color characteristics, to the transfer of its colorants to adjacent material, or both. For example, a change in color can result from exposure to conditions or agents such as light, perspiration, gases, etc. The resistance to a change in the color properties during home or commercial laundering is referred to as "washfastness."

"Laundering" as used herein refers to a process intended to remove soils and/or stains by treatment (washing) with a acqueous detergent solution and normally including subsequent rinsing, extracting, and drying.

"Crocking" as used herein refers to the transfer of color from the surface of a colored fabric to an adjacent area of the same fabric or to another surface principally by rubbing action.

Fabric Selection

While the method, or process, of the present invention may be used on different material types and nonwoven fabric constructions, one exemplary fabric construction will be described in detail. In particular, however, the present process can be applied to all nonwoven fabrics comprising two or more different fiber/yarn types. In the exemplary embodiment, the fabric is formed of about 70 percent polyester and 30 percent nylon for fabric constructions in weight ranges from 80 grams per square meter to about 100 grams per square meter. More particularly, the fabric comprises multiple hydroentangled webs/layers. Each of the layers is similar in structure and composition, but layers having different compositions are envisioned. One such nonwoven construction is available from Freudenberg Nonwovens of Durham, N.C. As those skilled in the art will appreciate, the nonwoven fabric constructions described herein may be formed in other ways. Thus, as a first step in the process of the present invention, a nonwoven fabric construction is selected comprising different fiber/yarn types.

Dyeing

An object of the dyeing process of the present invention is to produce a dyed nonwoven fabric of different fiber types having a relatively uniform color shade and a relatively high degree of colorfastness.

As is known to those of ordinary skill in textile chemistry, a preferred dyestuff for coloring polyester is a disperse dye. Disperse dyes are a class of slightly water-soluble dyes that are usually applied from aqueous dispersions and have a particular affinity for synthetic materials such as polyester. Disperse dyes, however, have not been found to be suitable for coloring nylon, another class of synthetic fibers having different chemical and dye affinity characteristics. For nylon, a preferred dyestuff is an acid dye. Acid dyes have a good affinity for nylon and a high degree of washfastness.

Where a single uniform color is desired, fabric constructions formed from different fiber types, either natural or synthetic, or combinations of natural and synthetic fiber types, are conventionally dyed with a process known as union dyeing. "Union dyeing" is a dyeing process whereby fabric containing two or more fiber or yarn types is dyed to the same color shade to achieve the appearance of a solid color fabric. Heretofore, however, these dyes have been sequentially applied in a process involving at least two dyeing steps.

The following is exemplary of one of the possible dye formulations that has been found suitable for dyeing of the nonwoven fabric described herein. A launderometer was employed to simulate dyeing in a laboratory setting to ascertain (1) acceptable temperature ranges of dyeing nonwoven fabric, and (2) to confirm the colorfastness of the dyed fabric.

Formulation I

A first formulation comprises a single solution comprising disperse dye to dye the polyester component of the fabric and an acid dye to dye the nylon component of the fabric. The formulation comprises an amount of dye having "X" percent disperse dye, the percentage corresponding to the percentage of polyester fibers in the fabric, adjusted for the desired color depth/shade. "Color depth" refers to the measured level of light reflectance using a spectrophotometer. Suitable disperse dyes are available from any number of dye manufacturers such as Ciba Specialty Chemicals of Greensboro, N.C. To this is added "Y" percent acid dye, again corresponding to the percentage of nylon fibers in the fabric, adjusted for the desired color depth/shade. One suitable acid dye is available from Ciba Specialty Chemicals. "Z" percent citric acid is next added to the solution to obtain a solution pH of between about 3.0 and 4.0, with a pH of about 3.3 being desirable. Citric acid promotes affinity of the dyes for the synthetic materials. Heretofore, a dye solution having a pH this low been would not have considered possible for either disperse or acid dye application. For example, conventional processes have required a pH of between about 4.5 and 5.0 for both polyester and nylon.

It has now been found that the disperse and acid dyestuffs can be combined in a single solution, where the percentage by weight of each type of dye is approximately equal to the percentage by weight of each fiber or yarn type. By way of example:

For 1000 pounds of a nonwoven fabric comprising 70 percent by weight (700 pounds) polyester and 30 percent by weight (300 pounds) nylon, the dye solution may comprise about 70 percent by weight disperse dye and about 30 percent by weight acid dye, with each adjusted for the desired dye shade/depth. Thus, using a hypothetical shade/depth multiplier/adjustment factor, for a medium blue shade, of 0.03 (3 percent) for the disperse dye and 0.0125 (1.25 percent) for the acid dye, the amount of each dye might be calculated as:

Disperse: 1000 pounds×0.70×0.03=21 pounds of dye

Acid: 1000 pounds×0.30×0.0125=3.75 pounds of dye.

As those skilled in the textile arts will appreciate, the determination of the color shade/depth multiplier is based upon laboratory testing for each dye type to obtain the desired shade; e.g., medium blue, for the particular fabric materials and fabric construction. Also, between about 0.1 percent and 1.0 percent by weight citric acid is added to the solution with about 0.3 percent being optimal.

Dyeing Process

Following the formulation of the dye solution, the nonwoven fabric is added to the solution in a dyeing machine/chamber. To ascertain the results of the dyeing process described herein, a high temperature launderometer was installed. A launderometer is an instrument for evaluating the colorfastness/washfastness of dyed and printed textiles when subjected to repeated laundering. As described in greater detail below, the measurements obtained from the launderometer are compared to widely accepted industry standards, including AATCC Test Method 61-1996 and AATCC Test Method 153-1985.

The solution, having an initial starting temperature of about 100 degrees Fahrenheit, is heated at approximately 3 degrees per minute to a temperature of about 250 degrees Fahrenheit, although a temperature of between 98 degrees Fahrenheit and 270 degrees Fahrenheit will produce acceptable results. Heretofore, and as is conventional today, nylon has a recommended dyeing and holding temperature of between 98 degrees Fahrenheit and 212 degrees Fahrenheit, while polyester has a recommended dyeing and holding temperature of between 265 degrees Fahrenheit and 270 degrees Fahrenheit. As those in the art will appreciate, to dye nylon at a temperature as high as 270 degrees Fahrenheit has not been believed to be efficacious. Nonetheless, when the single solution is mixed as described above, acceptable color depth and colorfastness have been achieved for this nonwoven fabric. At this temperature, the fabric is held in solution for a selected period of time. For this formulation, the hold time is approximately 45 minutes. Hold time is dependent upon the desired color of the dyed fabric and will vary between about 15 minutes and about 45 minutes; e.g., for a dark color such as black, the hold time would be about 45 minutes, whereas a lighter color such as yellow might have a hold time of about 15 minutes.

Following the hold time, the solution is then cooled to a temperature of between about 140 degrees Fahrenheit and 170 degrees Fahrenheit, and desirably about 158 degrees Fahrenheit, again cooling at a rate of about 3 degrees per minute.

Following cooling, the dye solution is drained and the nonwoven fabric is rinsed within the dye chamber to remove any residual dye and any impurities. The chamber is next filled with fresh water at a temperature of between about 110 degrees Fahrenheit and 120 degrees Fahrenheit. A caustic soda is added to the water to obtain a pH of between about 10.0 and 11.0, with 11.0 (very basic) being most desirable. A fixing agent is next added to affix the dyestuffs to the nonwoven fabric. Chemically, the fixing agent comprises alkyl amine. One suitable fixing agent is available from Ciba Specialty Chemical. The water, soda, and fixing agent solution is next heated to a temperature of between about 140 degrees Fahrenheit and 170 degrees Fahrenheit, with 158 degrees Fahrenheit proving most optimal. The inventors have found that temperatures above 170 degrees Fahrenheit will degrade the attachment of the disperse dye to the polyester component, resulting in poor colorfastness. The fixing solution is held at this temperature for about 20 minutes, followed by draining and rinsing of the fabric with water between about 100 degrees Fahrenheit and 120 degrees Fahrenheit.

The chamber is again filled with fresh water at a temperature of between about 100 degrees Fahrenheit and 120 degrees Fahrenheit. Acetic acid is added to neutralize the fabric to a pH of about 7.0 (neutral). The acetic acid solution is then heated to a temperature of between about 120 degrees Fahrenheit and 140 degrees Fahrenheit. The solution is held at this temperature for between about 5 and 20 minutes, with about 15 minutes being optimal. Subsequently, the chamber is again drained and rinsed with fresh water to complete the dyeing process. The fabric is then removed from the dye chamber, processed and dried using conventional processes to obtain any other desired properties.

The nonwoven fabric dyed in accordance with the present invention has been tested/graded for colorfastness in accordance with the evaluation procedures described in American Association of Textile Chemists and Colorists (AATCC) Test Method 61-1996, *Colorfastness to Laundering, Home and Commercial: Accelerated* ("Test Method 61"). Test Method 61 evaluates color loss and surface changes resulting from detergent solution and the abrasive action of five typical hand, home, or commercial launderings. Tested specimens are rated on a scale of 1 to 5, where a Grade 5 reveals negligible or no change in gray scale of the specimen and a Grade 1 reveals significant change in gray scale of the specimen. Thus, a Grade 5 according to Test Method 61 means that the specimen has negligible color loss after repeated launderings, whereas a Grade 1 indicates significant color loss. When evaluated in accordance with Test Method 61, the nonwoven fabric described herein was rated between Grade 4 and Grade 5, indicating a high degree of colorfastness. The content of Test Method 61 is herein incorporated by reference.

Additionally, the nonwoven fabric dyed as described herein has been tested/graded for color shade per the test/evaluation procedures of AATCC Test Method 153-1985, *Color Measurement of Textiles: Instrumental* ("Test Method 153"). Test Method 153 evaluates whether there is any difference or alteration in color shade between different areas of a single specimen. Measurements are performed by a spectrophotometer or calorimeter. In the interest of uniformity in the textile industry, Test Method 153 endorses formula CIE 1976 L*a*b*, as described in greater detail in Test Method 153, the content of which is herein incorporated. Measurements taken in accordance with Test Method 153 are graded in accordance with either AATCC Evaluation Procedure 2 (AATCC Technical Manual/1989), Gray Scale for Staining, or AATCC Evaluation Procedure 3 (AATCC Technical Manual/1989), *AATCC Chromatic Transference Scale*. Using either evaluation procedure, a Grade 5 indicates negligible or no color differences, and a Grade 1 indicates significant color shade differences between different areas of a specimen. When evaluated in accordance with Test Method 153 and either evaluation procedure, the nonwoven fabric described herein was rated between Grade 4 and Grade 5, indicating minimal or negligible color shade differences. Thus, a nonwoven fabric comprising different synthetic materials, when dyed according to the process of the present invention, i.e., in a single dye bath comprising a solution of disperse and acid dyes, had a consistent and uniform color shade. Heretofore, this was unexpected in the textile chemical arts.

In addition to the test methods described above, the dyed nonwoven fabric was tested for colorfastness to crocking in accordance with AATCC Test Method 8-1996, *Colorfastness to Crocking: AATCC Crockmeter Test* ("Test Method 8"). Test Method 8 is designed to determine the amount of color transferred from the surface of the dyed fabric to a white crock test cloth. Using the evaluation procedure described in Test Method 8, the dyed nonwoven fabric of the present invention was rated between Grade 4 and Grade 5, indicating negligible or minimal color transfer.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents. It should also be understood that terms used herein should be given their ordinary meaning to a person of ordinary skill in the art, unless specifically defined or limited in the application itself or in the ensuing prosecution with the Patent Office.

I claim:

1. A method of dyeing a nonwoven fabric comprising a blend of fibers to a single color shade, the method comprising:

selecting a nonwoven fabric formed of a blend of polyester and nylon fibers, the polyester fibers comprising an amount of about X percent by weight of the fabric and the nylon fibers comprising an amount of about Y percent by weight of the fabric;

formulating in a single bath an amount of dye comprising about X percent by weight disperse dye and about Y percent by weight acid dye, wherein the percentage by weight of each type of dye is equal to the percentage by weight of each type of fiber, the amount of each dye adjusted for the desired color shade; and dyeing the nonwoven fabric to obtain a dyed fabric having a uniform color shade throughout of at least Grade 4 when measured in accordance with AATCC Test Method 153 and a colorfastness of at least Grade 4 when measured in accordance with AATCC Test Method 61.

2. The method of claim 1 further comprising the step of adjusting the pH of the dye bath to a value of less than 4.0.

3. The method of claim 2 wherein the pH is adjusted to a value of less than 3.5.

4. The method of claim 3 wherein the pH is adjusted to a value of about 3.3.

5. The method of claim 2 wherein the pH of the bath is adjusted by the addition of an acidic material.

6. The method of claim 5 wherein the acidic material is a citric acid added in an amount of between about 0.1 percent and 1.0 percent by weight of the nonwoven fabric.

7. The method of claim 6 wherein the citric acid is added in an amount of about 0.3 percent by weight of the nonwoven fabric.

8. The method of claim 1 wherein the dyed fabric has a crock rating of at least Grade 4 when measured in accordance with AATCC Test Method 8.

9. The method of claim 1 wherein the nonwoven fabric comprises about 70 percent polyester fibers.

10. The method of claim 1 wherein the nonwoven fabric is dyed at a temperature between about 250 degrees Fahrenheit and 270 degrees Fahrenheit.

* * * * *